US011319724B2

(12) United States Patent
Zavitz

(10) Patent No.: US 11,319,724 B2
(45) Date of Patent: May 3, 2022

(54) SYSTEM AND METHOD FOR COUPLING A POST TO A FOUNDATION

(71) Applicant: Tindall Corporation, Spartanburg, SC (US)

(72) Inventor: Bryant Zavitz, Dunwoody, GA (US)

(73) Assignee: Tindall Corporation, Spartanburg, SC (US)

( * ) Notice: Subject to any disclaimer, the term of this patent is extended or adjusted under 35 U.S.C. 154(b) by 0 days.

(21) Appl. No.: 16/944,548

(22) Filed: Jul. 31, 2020

(65) Prior Publication Data

US 2021/0032892 A1 Feb. 4, 2021

Related U.S. Application Data

(60) Provisional application No. 62/881,694, filed on Aug. 1, 2019.

(51) Int. Cl.
*E04H 12/22* (2006.01)
*E02D 27/42* (2006.01)

(52) U.S. Cl.
CPC ..... *E04H 12/2276* (2013.01); *E02D 27/42* (2013.01)

(58) Field of Classification Search
CPC . E04H 12/2276; E04H 12/22; E04H 12/2253; E04H 12/2261; E02D 27/42
See application file for complete search history.

(56) References Cited

U.S. PATENT DOCUMENTS 1,606,697 A * 11/1926 Dean ..... E04H 12/2276 52/295
1,647,925 A * 11/1927 John ..... E02D 27/42 52/223.5
4,603,526 A * 8/1986 Bollmann ..... G11B 7/08517 52/296
4,662,139 A * 5/1987 Bollmann ..... E02D 27/42 52/296
5,666,774 A * 9/1997 Commins ..... E04H 12/2253 248/188.4
RE36,550 E * 2/2000 West ..... A47G 29/1216 248/183.1
6,141,928 A * 11/2000 Platt ..... E04F 11/1812 52/296
7,475,479 B1 * 1/2009 Ross ..... E04F 11/1812 29/525.01
9,644,393 B2 * 5/2017 McCue ..... E01F 13/022
10,378,231 B1 * 8/2019 Sharpe ..... E04H 12/2238
10,519,686 B2 * 12/2019 Tate ..... E04H 12/2223
(Continued)

*Primary Examiner* — Gisele D Ford
(74) *Attorney, Agent, or Firm* — Meunier Carlin & Curfman LLC

(57) ABSTRACT

Various implementations include a system for coupling a post to a foundation. The system includes a rod having a first rod end and a second rod end. The first rod end is spaced apart from a top surface of the foundation, and the second rod end is coupled to the foundation. The post has at least one side wall at least partially defining an inner cavity and an inner tube disposed within the inner cavity and coupled to the at least one side wall. The inner tube has a first tube end and a second tube end that is closer than the first tube end to a bottom end of the post. A portion of the rod is disposable within the inner tube such that the first rod end is axially spaced apart from the first tube end. The first rod end is couplable to the first tube end.

20 Claims, 4 Drawing Sheets

(56) References Cited

U.S. PATENT DOCUMENTS

| | | | | |
|---|---|---|---|---|
| 10,689,857 | B2 * | 6/2020 | Van Lennep | E04F 11/1812 |
| 10,774,562 | B1 * | 9/2020 | Parker | E04F 11/1812 |
| 2004/0040224 | A1 * | 3/2004 | Dayton | E02D 27/42 52/93.1 |
| 2006/0053714 | A1 * | 3/2006 | Pryor | E02D 27/42 52/292 |
| 2006/0054765 | A1 * | 3/2006 | Griengl | E04H 12/2261 248/346.01 |
| 2007/0006541 | A1 * | 1/2007 | Seidel | E02D 27/42 52/292 |
| 2009/0279959 | A1 * | 11/2009 | Bakos | E02D 27/42 405/231 |
| 2009/0282774 | A1 * | 11/2009 | Jensen | E04H 12/085 52/698 |
| 2011/0041438 | A1 * | 2/2011 | Frost | E02D 27/42 52/296 |
| 2013/0199117 | A1 * | 8/2013 | Tuominen | E02D 27/42 52/297 |
| 2014/0318033 | A1 * | 10/2014 | Coordes | F03D 13/22 52/40 |
| 2017/0321446 | A1 * | 11/2017 | Antinolfi | E04H 12/2292 |
| 2019/0112829 | A1 * | 4/2019 | Manos | E04H 12/04 |
| 2019/0203494 | A1 * | 7/2019 | West | E04B 1/40 |
| 2020/0208430 | A1 * | 7/2020 | LeAnna | E04H 12/2261 |

* cited by examiner

SYSTEM AND METHOD FOR COUPLING A POST TO A FOUNDATION

CROSS REFERENCE TO RELATED APPLICATIONS

This application claims the benefit of U.S. Provisional Patent Application No. 62/881,694, filed Aug. 1, 2019, the content of which is incorporated herein by reference in its entirety.

BACKGROUND

Many structures are built upon frames coupled to foundations. The vertical posts of these frames often include angle brackets or "feet" that extend outwardly from sidewalls of the posts along the foundation and define a fastener opening. To couple the post to the foundation, a bolt or other fastener is fastened through the fastener opening and into the foundation.

However, this type of connection is known to be brittle. During seismic activity, the structure is subjected to cycles of compression and tension which can cause these brittle connections to fail. This failure of the frame-foundation connection could cause the failure of the structure. Thus, a need exists for a system and a method for connecting a post to a foundation that are not brittle to withstand seismic forces.

SUMMARY

Various implementations include a system for coupling a post to a foundation. The system includes a foundation, a rod, and a post. The foundation has a top surface. The rod has a first rod end and a second rod end opposite and spaced apart from the first rod end. The first rod end is spaced apart from the top surface of the foundation and the second rod end is coupled to the foundation. The post has at least one side wall that at least partially defines an inner cavity and an inner tube disposed within the inner cavity and coupled to the at least one side wall. The at least one side wall has a bottom end. The inner tube has a first tube end and a second tube end opposite and spaced apart from the first tube end. The second tube end is closer than the first tube end to the bottom end of the post. A portion of the rod is disposable within the inner tube such that the first rod end is axially spaced apart from the first tube end. The first rod end is couplable to the first tube end.

In some implementations, the rod includes a threaded portion extending from the first rod end toward the second rod end. The first rod end is coupled to the first tube end by coupling a nut to the threaded portion of the rod.

In some implementations, at least one of the at least one side wall defines a side wall opening. The side wall opening is radially adjacent the first tube end such that the first tube end is accessible through the side wall opening.

In some implementations, the at least one side wall of the post includes a first side wall, a second side wall, a third side wall, and a fourth side wall.

In some implementations, each of the at least two side walls define a side wall opening. The side wall openings are radially adjacent the first tube end such that the first tube end is accessible through the side wall openings.

In some implementations, the post has a square cross-section in a plane parallel to the bottom end of the at least one side wall. The post has a width measured from opposing side walls. The inner tube has a length measured from the first tube end to the second tube end. The length of the tube is at least 1.5 times the width of the post.

In some implementations, the post further includes a bottom wall coupled to the bottom end of the post. The bottom wall defines a bottom wall opening. The second tube end is coupled to the bottom wall, and the portion of the rod that is disposable within the inner tube is extendable through the bottom wall opening.

In some implementations, the system further includes at least one shim that is disposable between the bottom end of the at least one side wall of the post and the top surface of the foundation.

In some implementations, the top surface of the foundation defines a foundation opening. The second rod end is disposed within the foundation opening and coupled to the foundation by grout disposed in the foundation opening.

In some implementations, the inner tube has a length measured from the first tube end to the second tube end. The length of the tube is from 6 to 18 inches.

Various other implementations include a method of coupling a post to a foundation. The method includes coupling a rod to a foundation, disposing the rod within an inner tube of a post, and coupling the first rod end to the first tube end. The rod has a first rod end and a second rod end opposite and spaced apart from the first rod end. The first rod end is spaced apart from the top surface of the foundation and the second rod end is coupled to the foundation. The post has at least one side wall that least partially defines an inner cavity and the inner tube disposed within the inner cavity and coupled to the at least one side wall. The at least one side wall has a bottom end. The inner tube has a first tube end and a second tube end opposite and spaced apart from the first tube end. The second tube end is closer than the first tube end to the bottom end of the post. The first rod end is axially spaced apart from the first tube end.

In some implementations, the rod includes a threaded portion extending from the first rod end toward the second rod end. Coupling the first rod end to the first tube end includes coupling a nut to the threaded portion of the rod.

In some implementations, at least one of the at least one side wall defines a side wall opening. The side wall opening is radially adjacent the first tube end such that the first tube end is accessible through the side wall opening.

In some implementations, the at least one side wall of the post includes a first side wall, a second side wall, a third side wall, and a fourth side wall.

In some implementations, each of the at least two side walls define a side wall opening. The side wall openings are radially adjacent the first tube end such that the first tube end is accessible through the side wall openings.

In some implementations, the post has a square cross-section in a plane parallel to the bottom end of the at least one side wall. The post has a width measured from opposing side walls. The inner tube has a length measured from the first tube end to the second tube end. The length of the tube is at least 1.5 times the width of the post.

In some implementations, the post further includes a bottom wall coupled to the bottom end of the post. The bottom wall defines a bottom wall opening. The second tube end is coupled to the bottom wall. The method further includes disposing the rod through the inner tube and the bottom wall opening.

In some implementations, the method further includes disposing at least one shim between the bottom end of the at least one side wall of the post and the top surface of the foundation.

In some implementations, the top surface of the foundation defines a foundation opening. Coupling the rod to the foundation includes disposing the second rod end in the foundation opening and surrounding the second rod end and a portion of the rod between the top surface and second rod end with grout.

In some implementations, the inner tube has a length measured from the first tube end to the second tube end. The length of the tube is from 6 to 18 inches.

BRIEF DESCRIPTION OF DRAWINGS

Example features and implementations are disclosed in the accompanying drawings. However, the present disclosure is not limited to the precise arrangements and instrumentalities shown.

DETAILED DESCRIPTION

Various implementations include a system for coupling a post to a foundation. The system includes a foundation, a rod, and a post. The foundation has a top surface. The rod has a first rod end and a second rod end opposite and spaced apart from the first rod end. The first rod end is spaced apart from the top surface of the foundation, and the second rod end is coupled to the foundation. The post has at least one side wall at least partially defining an inner cavity and an inner tube disposed within the inner cavity and coupled to the at least one side wall. The at least one side wall has a bottom end, and the inner tube has a first tube end and a second tube end opposite and spaced apart from the first tube end. The second tube end is closer than the first tube end to the bottom end of the post. A portion of the rod is disposable within the inner tube such that the first rod end is axially spaced apart from the first tube end. The first rod end is couplable to the first tube end.

Various other implementations include a method of coupling a post to a foundation. The method includes coupling a rod to a foundation. The rod has a first rod end and a second rod end opposite and spaced apart from the first rod end. The first rod end is spaced apart from the top surface of the foundation, and the second rod end is coupled to the foundation. The method further includes disposing the rod within an inner tube of a post. The post has at least one side wall at least partially defining an inner cavity, and the inner tube is disposed within the inner cavity and coupled to the at least one side wall. The at least one side wall has a bottom end, and the inner tube has a first tube end and a second tube end opposite and spaced apart from the first tube end. The second tube end is closer than the first tube end to the bottom end of the post. The first rod end is axially spaced apart from the first tube end. The method further includes coupling the first rod end to the first tube end.

Figure 1:
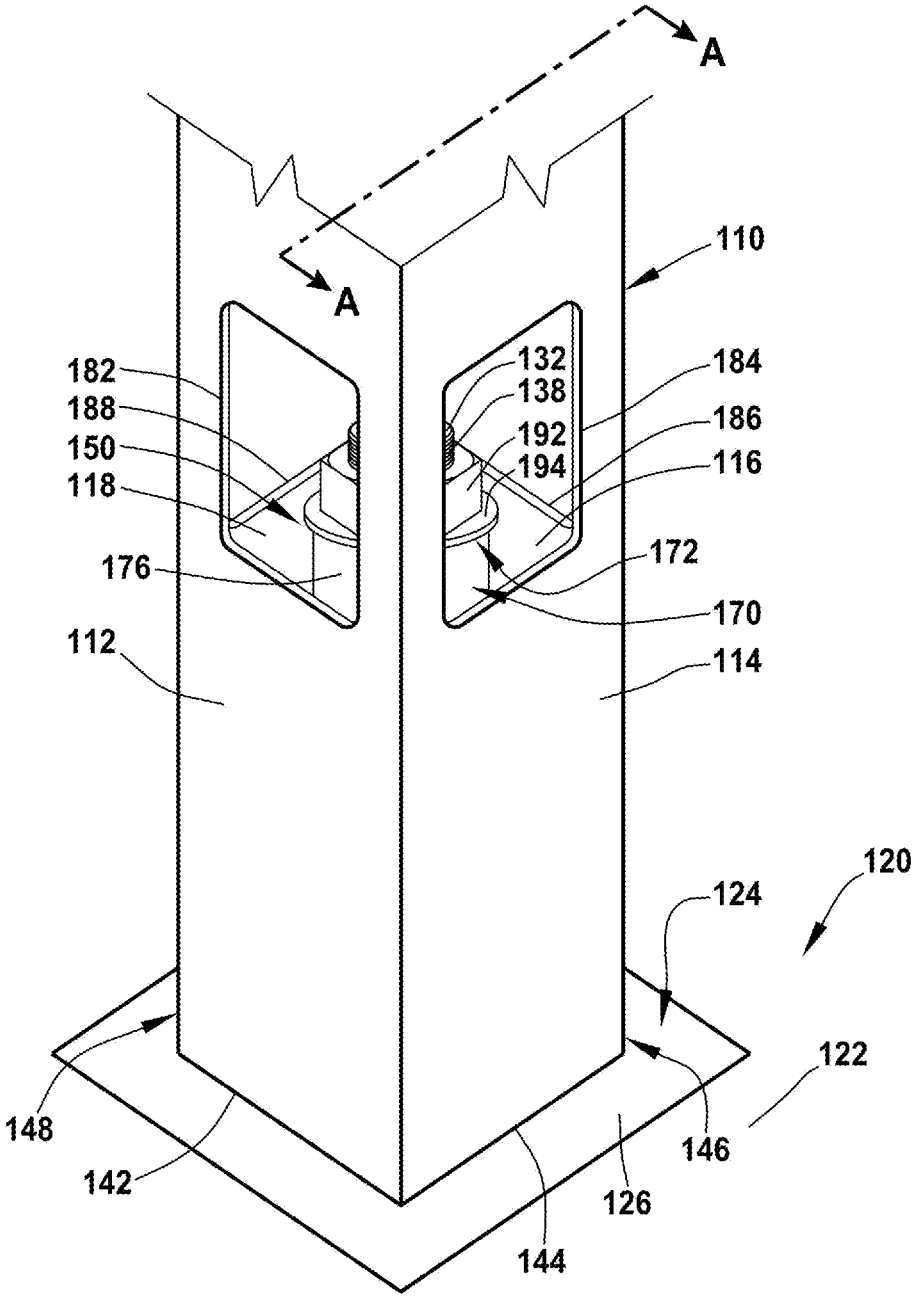
FIG. 1 is a perspective view of a system for coupling a post to a foundation, according to one implementation.
Figure 2:
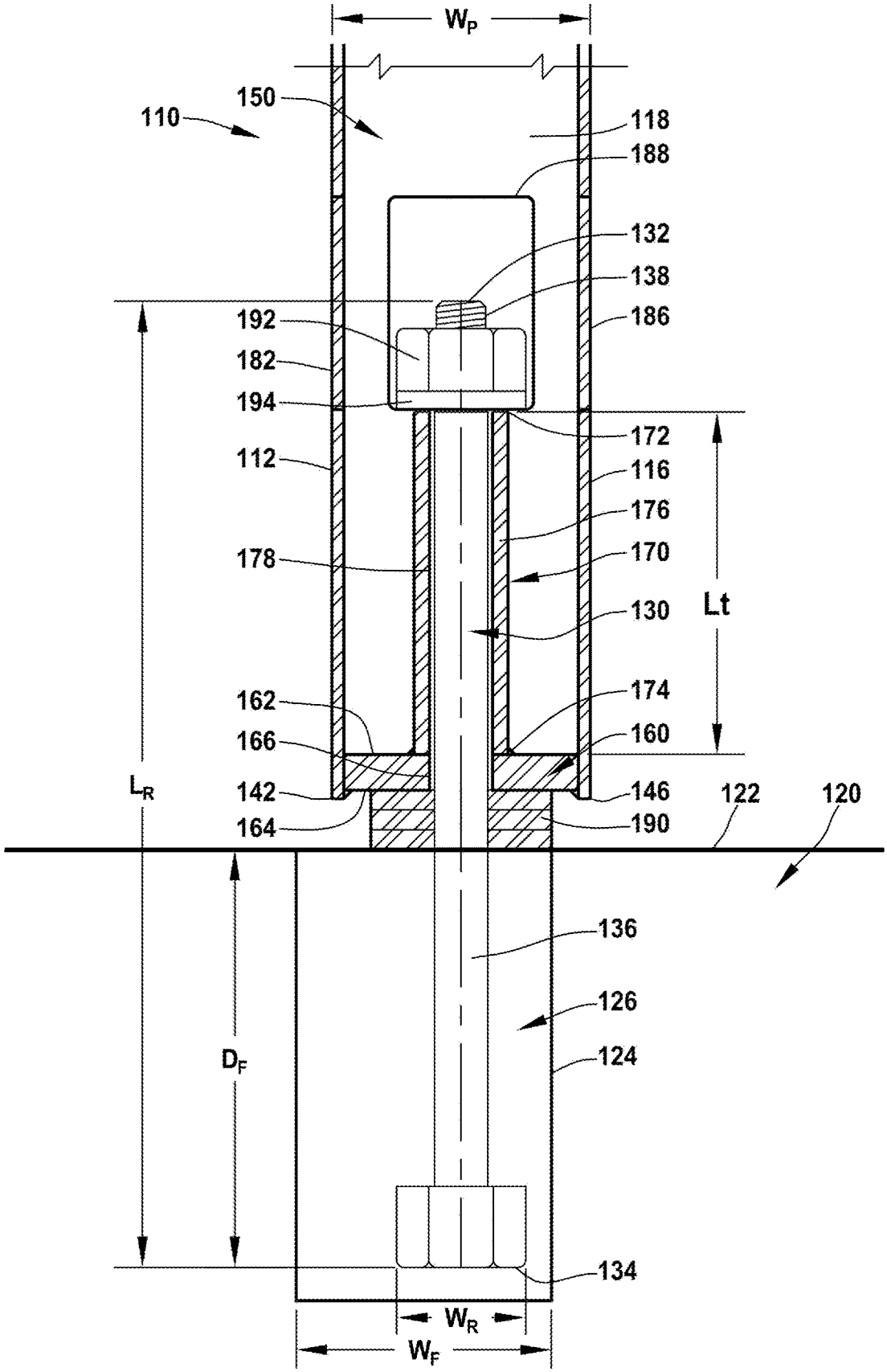
FIG. 2 is a cross sectional view of the system for coupling a post to a middle portion of a foundation of FIG. 1 through line A-A of FIG. 1.
Figure 3:
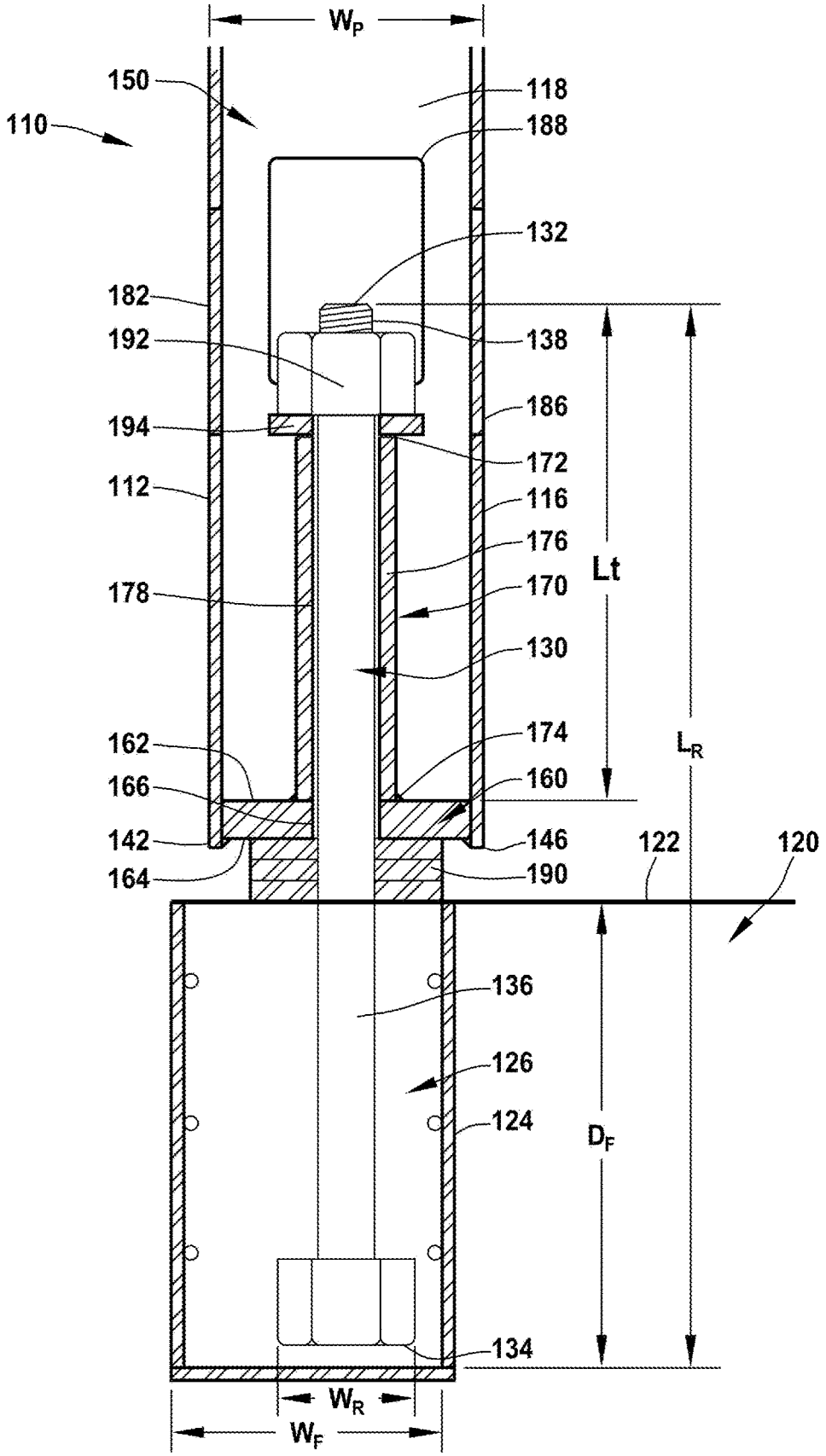
FIG. 3 is another cross-sectional view of the system for coupling a post to an edge portion of a foundation of FIG. 1.

FIGS. 1-3 show a system according to one implementation. The system includes a foundation 120, a rod 130, and a post 110. The post 110 is coupled to the foundation 120 via the rod 130. In FIG. 2, the post 110 is connected to a middle portion of the foundation 120, and in FIG. 3, the post 110 is connected to a side portion of the foundation 120 adjacent an edge of the foundation 120.

The foundation 120 includes pour-in-place concrete and has a top surface 122. The top surface 122 of the foundation 120 defines a foundation opening 124. Although the foundation 120 shown in FIGS. 1-3 is made of concrete, in other implementations, the foundation 120 can be made of any material.

The rod 130, which is shown in FIGS. 2 and 3, has a first rod end 132, a second rod end 134 spaced apart and opposite the first rod end 132, and a side surface 136 extending between the first rod end 132 and the second rod end 134. The second rod end 134 is disposed in the foundation opening 124. The rod 130 is coupled to the foundation 120 by grout 126 disposed in the foundation opening 124, and the grout 126 surrounds the second rod end 134. As shown in FIGS. 1-3, the foundation opening 124 has a width $W_F$ that is larger than the width $W_R$ of the rod 130. Before the rod 130 is grouted in the foundation opening 124, a survey of the foundation 120 is performed to determine the precise location where the rod 130 should be located. The relatively larger width $W_F$ of the foundation opening 124 allows for a tolerance in the location of the rod 130. Once the location of the rod 130 is determined, the rod 130 is placed in the desired location, and grout 126 is poured into the foundation opening 124 to couple the second rod end 134 to the foundation 120.

The rod 130 has a length $L_R$ that is longer than the depth $D_F$ of the foundation opening 124 such that, when the second rod end 134 is disposed within the foundation opening 124 and coupled to the foundation 120 by grout 126, the first rod end 132 is spaced apart from the top surface 122 of the foundation 120.

The side surface 136 of the rod 130 adjacent the first rod end 132 includes a threaded portion 138 extending toward the second rod end 134. In some implementations, the rod 130 is a bolt and the threaded portion of the bolt includes the first rod end 132.

The post 110 has a first side wall 112, a second side wall 114, a third side wall 116, and a fourth side wall 118, and each of the four side walls 112, 114, 116, 118 has a bottom end 142, 144, 146, 148, respectively. The post 110 in FIGS. 1-3 has a square cross section in a plane perpendicular to the bottom ends 142, 144, 146, 148 of the side walls 112, 114, 116, 118. The four side walls 112, 114, 116, 118 at least partially define an inner cavity 150.

Figure 4:
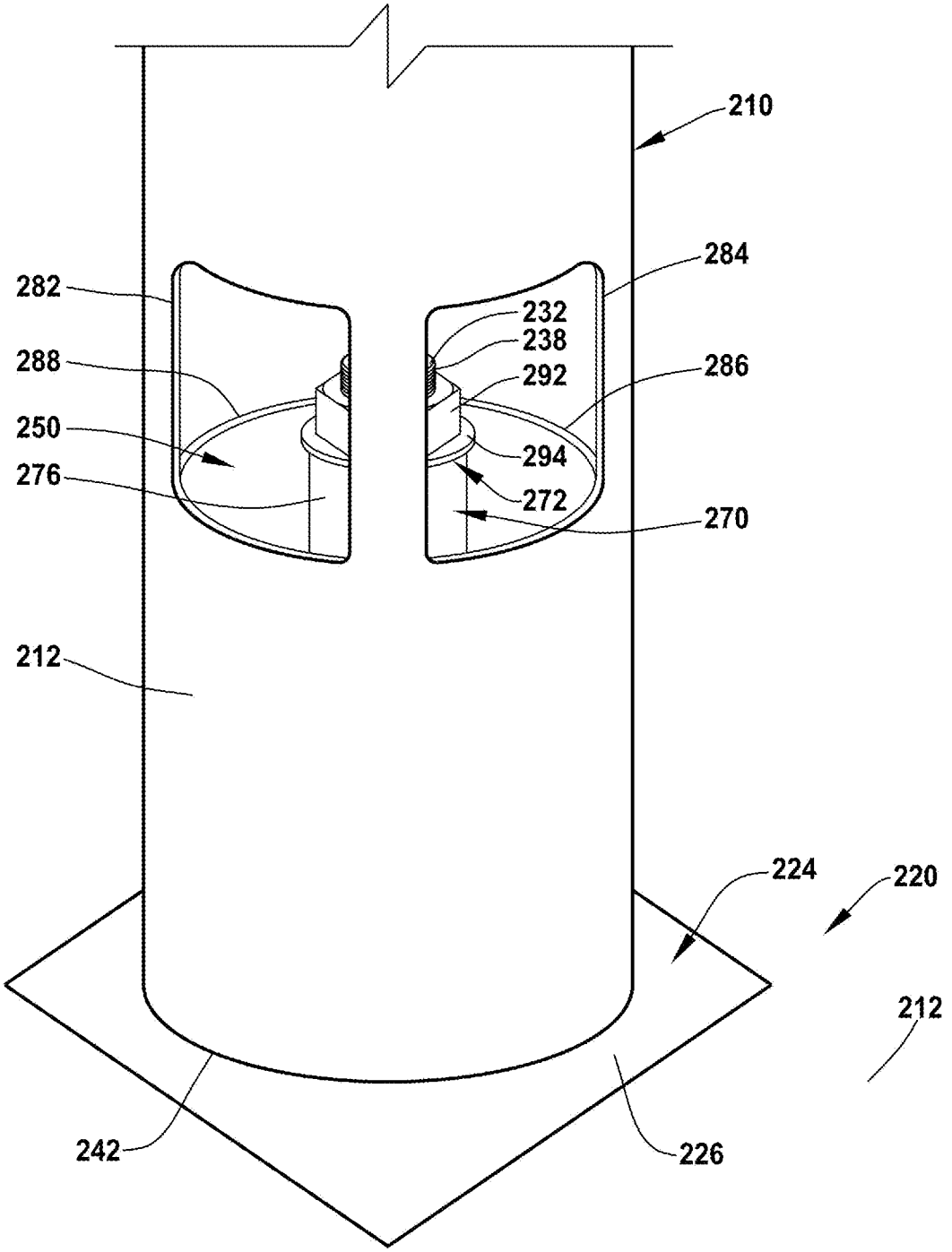
FIG. 4 is a perspective view of a system for coupling a post to a foundation, according to another implementation.

Although the post 110 shown in FIGS. 1-3 includes four side walls 112, 114, 116, 118, in other implementations, the post 110 includes one or more side walls 112, 114, 116, 118 such that the cross section of the post 110 in a plane that bisects a central longitudinal axis of the post 110 is a circle, ellipsis, triangle, rectangle, or any other closed shape as viewed in the plane. FIG. 4 shows an implementation of a system for coupling a post 210 to the foundation 120 in which the post 210 includes only one side wall 212 such that the cross section of the post 210 in the plane that bisects the central longitudinal axis of the post 210 is a circle.

The side walls 112, 114, 116, 118 in FIGS. 1-3 are steel, but in other implementations, the side walls are any other material capable of withstand the loads of the structure and seismic activity.

The post 110 further includes a bottom wall 160 having a first side 162 and a second side 164. The bottom wall 160 is coupled to the bottom ends 142, 144, 146, 148 of the four side walls 112, 114, 116, 118, respectively, such that the first side 162 of the bottom wall 160 is facing the inner cavity 150 of the post 110. The bottom wall 160 defines a bottom wall opening 166 extending through the first side 162 of the bottom wall 160 and the second side 164 of the bottom wall 160. The bottom wall opening 166 has a diameter that is larger than a portion of the rod 130 to be disposed within the bottom wall opening 166, as discussed below.

The bottom wall 160 shown in FIGS. 1-3 is welded to each of the four side walls 112, 114, 116, 118, but in other implementations, the bottom wall 160 is integrally formed with the side walls 112, 114, 116, 118 or is coupled to the side walls 112, 114, 116, 118 by one or more fastener, tabs inserted into slots, or any other fastener or fastening mechanism suitable for coupling the bottom wall 160 to the side walls 112, 114, 116, 118 such that the post 110 can withstand the loads of the structure and seismic activity. Although the bottom wall 160 in FIGS. 1-3 is coupled to all four side walls 112, 114, 116, 118, in other implementations, the bottom wall 160 is coupled to any number of side walls 112, 114, 116, 118. The bottom wall 160 shown in FIGS. 1-3 is disposed within the portion of the inner cavity 150 defined by side walls 112, 114, 116, 118, but in other implementations, the bottom wall 160 is disposed outside this portion of the inner cavity 150. For example, the bottom wall 160 can be coupled to the bottom end 142, 144, 146, 148 of one or more of the side walls 112, 114, 116, 118.

The bottom wall 160 in FIGS. 1-3 is steel, but in other implementations, the bottom wall 160 is any other material capable of withstand the loads of the structure and seismic activity.

The post 110 also includes an inner tube 170 disposed within the inner cavity 150. The inner tube 170 has a first tube end 172, a second tube end 174 opposite and spaced apart from the first tube end 172, and a tube wall 176 extending between the first tube end 172 and the second tube end 174. A tube opening 178 is defined through the tube 170 and extends between the first tube end 172 and the second tube end 174 along a central longitudinal axis of the inner tube 170. The second tube end 174 is closer than the first tube end 172 to the bottom ends 142, 144, 146, 148 of the side walls 112, 114, 116, 118. The second tube end 174 is coupled to the first side 162 of the bottom wall 160 such that the tube opening 178 is aligned with the bottom wall opening 166. The tube opening 178 has a diameter that is larger than a diameter of a portion of the rod 130 to be disposed within the tube opening 178, as discussed below.

Although the second tube end 174 of the inner tube 170 shown in FIGS. 1-3 is coupled to the first side 162 of the bottom wall 160, in other implementations, any portion of the inner tube 170 is coupled to any portion of the bottom wall 160 such that a portion of the rod 130 can be disposed within the tube opening 178 of the inner tube 170. The inner tube 170 in FIGS. 1-3 is welded to the bottom wall 160, but in other implementations, the inner tube 170 is coupled to the bottom wall 160 by fasteners, tabs in slots, or any other fastener or fastening mechanism suitable for coupling the inner tube 170 to the bottom wall 160 such that the post 110 can withstand the loads of the structure and seismic activity. In some implementations, the post 110 does not include a bottom wall 160 coupling the inner tube 170 to the side walls 112, 114, 116, 118, and the inner tube 170 is coupled directly to the side walls 112, 114, 116, 118 or is coupled to the side walls 112, 114, 116, 118 by spacers.

The inner tube 170 in FIGS. 1-3 is steel, but in other implementations, the inner tube 170 is any other material capable of withstanding the loads of the structure and seismic activity. In some implementations, the tube wall comprises a stiff spring.

The post 110 has an outer width $W_P$ measured from the outer surfaces of opposing side walls 112, 114, 116, 118, and the inner tube 170 has a length $L_T$ measured from the first tube end 172 to the second tube end 174. The length $L_T$ of the tube 170 is 1.5 times the outer width $W_P$ of the post 110. For example, in FIGS. 1-3, the outer width $W_P$ is 6 inches and the length $L_T$ of the inner tube 170 is 9 inches. In other implementations, the length of the tube is greater than 1.5 times the width of the post 110. In some implementations, the length of the inner tube 170 is from 6 to 18 inches.

As shown in FIGS. 1-3, each of the four side walls 112, 114, 116, 118 defines a side wall opening 182, 184, 186, 188 extending to the inner cavity 150. The side wall openings 182, 184, 186, 188 are radially adjacent the first tube end 172 such that the first tube end 172 is accessible through each of the side wall openings 182, 184, 186, 188. During assembly, a user can access the first rod end 132 through any of the side wall openings 182, 184, 186, 188 to couple the first rod end 132 to the first tube end 172. In the implementation shown in FIG. 4, the post 210 only includes one side wall 212, and the side wall 212 defines four side wall openings 282, 284, 286, 288. Although the side walls 112, 114, 116, 118 in FIGS. 1-3 each include one side wall opening 182, 184, 186, 188 and the side wall 212 in FIG. 4 includes four side wall openings 282, 284, 286, 288, in other implementations, each side wall can include any number of one or more side wall openings.

To couple the post 110 to the foundation 120, a user first couples the rod 130 to the foundation 120 by grouting the second rod end 134 within the foundation opening 124, as discussed above. Once the grout 126 is set, one or more shims 190 are placed around the rod 130 to level the portion of the foundation 120 below where the post 110 will be disposed. The first rod end 132 is inserted through the bottom wall opening 166 and the tube opening 178 such that the first rod end 132 is axially spaced apart from the first tube end 172. For example, the bottom wall opening 166 and the tube opening 178 of the post 110 is slid over the first rod end 132 until the second side 164 of the bottom wall 160 abuts the distal-most shim 190. In this position, the threaded portion 138 of the side surface 136 of the rod 130 is exposed axially beyond the first tube end 172. In other words, the threaded portion 138 extends distally and axially from a plane that includes the first tube end 172. A nut 192 and washer 194 are then coupled to the threaded portion 138 of the rod 130 via access through one of the four side wall openings 182, 184, 186, 188. The nut 192 is tightened against the first tube end 172 to couple the first rod end 132 to the first tube end 172. Although FIGS. 1-3 show a nut 192 and washer 194 coupling the first rod end 132 to the first tube end 172, in other implementations, the first rod end is coupled to the first tube end by welding, another fastener, or any other fastening mechanism suitable for withstanding the loads of the structure and seismic activity.

In the event of seismic activity, the ground is subjected to a ripple effect wherein portions of the ground cycle between rising and falling. During the seismic activity, the posts of a structure cycle between being under tension and being under compression due to this ripple effect. These forces can cause damage or even failure of a structure.

As seen in FIGS. 1-3, a relatively long portion of the rod 130 extends between the top surface 122 of the foundation 120 and washer 194. In the connection shown in FIGS. 1-3, this distance includes the total thickness of the one or more shims 190, the thickness of the bottom wall 160, and the length of the inner tube 170 that extends from the bottom wall 160. When the connection is under tension, during seismic activity, for example, the relatively long portion of the rod 130 between the top surface 122 of the foundation 120 and the washer 194 is capable of stretching to absorb the force. In contrast, if a post is connected to the foundation directly, the connection will be brittle and would fail under the same forces.

Although the side wall openings 182, 184, 186, 188 allow for access to the first tube end 172, the side wall openings 182, 184, 186, 188 also absorb compression forces caused by seismic activity. Because each of the side walls 112, 114, 116, 118 of the post 110 define side wall openings 182, 184, 186, 188 in the same portion $P_P$ of the post 110, there is less post material in that portion $P_P$. When the post 110 is under compression, the remaining post material is capable of partially deforming to absorb the force (e.g., bending radially outwardly).

Thus, the devices, systems, and methods disclosed herein can absorb the forces caused by seismic activity to prevent failure of a structure.

A number of example implementations are provided herein. However, it is understood that various modifications can be made without departing from the spirit and scope of the disclosure herein. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. Although the terms "comprising" and "including" have been used herein to describe various implementations, the terms "consisting essentially of" and "consisting of" can be used in place of "comprising" and "including" to provide for more specific implementations and are also disclosed.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed each and every combination and permutation of the device, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

What is claimed is:

1. A system for coupling a post to a foundation, the system comprising:

a foundation having a top surface;

a rod having a first rod end and a second rod end opposite and spaced apart from the first rod end, the first rod end being spaced apart from the top surface of the foundation and the second rod end being coupled to the foundation; and a post having at least one side wall at least partially defining an inner cavity and an inner tube disposed within the inner cavity and fixedly coupled to the at least one side wall, the at least one side wall having a bottom end and the inner tube having a first tube end and a second tube end opposite and spaced apart from the first tube end, wherein the second tube end is closer than the first tube end to the bottom end of the post, wherein a portion of the rod is disposable within the inner tube such that the first rod end is axially spaced apart from the first tube end, and wherein the first rod end is directly couplable to the first tube end.

2. The system of claim 1, wherein the rod includes a threaded portion extending from the first rod end toward the second rod end, and the first rod end is coupled to the first tube end by coupling a nut to the threaded portion of the rod.

3. The system of claim 1, wherein at least one of the at least one side wall defines a side wall opening, the side wall opening being radially adjacent the first tube end such that the first tube end is accessible through the side wall opening.

4. The system of claim 1, wherein the at least one side wall of the post comprises a first side wall, a second side wall, a third side wall, and a fourth side wall.

5. The system of claim 4, wherein each of the first side wall, the second side wall, the third side wall, and the fourth side wall define a side wall opening, the side wall openings being radially adjacent the first tube end such that the first tube end is accessible through the side wall openings.

6. The system of claim 4, wherein the post has a square cross-section in a plane parallel to the bottom end of the at least one side wall, the post having a width measured from opposing side walls, and the inner tube having a length measured from the first tube end to the second tube end, wherein the length of the tube is at least 1.5 times the width of the post.

7. The system of claim 1, wherein the post further comprises a bottom wall coupled to the bottom end of the post, the bottom wall defining a bottom wall opening, wherein the second tube end is coupled to the bottom wall, and the portion of the rod that is disposable within the inner tube is extendable through the bottom wall opening.

8. The system of claim 1, further comprising at least one shim that is disposable between the bottom end of the at least one side wall of the post and the top surface of the foundation.

9. The system of claim 1, wherein the top surface of the foundation defines a foundation opening, and wherein the second rod end is disposed within the foundation opening and coupled to the foundation by grout disposed in the foundation opening.

10. The system of claim 1, wherein the inner tube has a length measured from the first tube end to the second tube end, wherein the length of the tube is from 6 to 18 inches.

11. A method of coupling a post to a foundation, the method comprising:

coupling a rod to a foundation, the rod having a first rod end and a second rod end opposite and spaced apart from the first rod end, the first rod end being spaced apart from the top surface of the foundation and the second rod end being coupled to the foundation;

disposing the rod within an inner tube of a post, the post having at least one side wall at least partially defining an inner cavity and the inner tube disposed within the inner cavity and fixedly coupled to the at least one side wall, the at least one side wall having a bottom end and the inner tube having a first tube end and a second tube end opposite and spaced apart from the first tube end, wherein the second tube end is closer than the first tube end to the bottom end of the post, wherein the first rod end is axially spaced apart from the first tube end; and directly coupling the first rod end to the first tube end.

12. The method of claim 11, wherein the rod includes a threaded portion extending from the first rod end toward the second rod end, and coupling the first rod end to the first tube end comprises coupling a nut to the threaded portion of the rod.

13. The method of claim 11, wherein at least one of the at least one side wall defines a side wall opening, the side wall opening being radially adjacent the first tube end such that the first tube end is accessible through the side wall opening.

14. The method of claim 11, wherein the at least one side wall of the post comprises a first side wall, a second side wall, a third side wall, and a fourth side wall.

15. The method of claim 14, wherein each of the first side wall, the second side wall, the third side wall, and the fourth side wall define a side wall opening, the side wall openings being radially adjacent the first tube end such that the first tube end is accessible through the side wall openings.

16. The method of claim 14, wherein the post has a square cross-section in a plane parallel to the bottom end of the at least one side wall, the post having a width measured from opposing side walls, and the inner tube having a length measured from the first tube end to the second tube end, wherein the length of the tube is at least 1.5 times the width of the post.

17. The method of claim 11, wherein the post further comprises a bottom wall coupled to the bottom end of the post, the bottom wall defining a bottom wall opening, wherein the second tube end is coupled to the bottom wall, and the method further comprises disposing the rod through the inner tube and the bottom wall opening.

18. The method of claim 11, further comprising disposing at least one shim between the bottom end of the at least one side wall of the post and the top surface of the foundation.

19. The method of claim 11, wherein the top surface of the foundation defines a foundation opening, and wherein coupling the rod to the foundation comprises disposing the second rod end in the foundation opening and surrounding the second rod end and a portion of the rod between the top surface and second rod end with grout.

20. The method of claim 11, wherein the inner tube has a length measured from the first tube end to the second tube end, wherein the length of the tube is from 6 to 18 inches.

* * * * *